United States Patent [19]

Breuers et al.

[11] 4,095,782

[45] Jun. 20, 1978

[54] COLLATING APPARATUS

[75] Inventors: Theo Pierre Chretien Breuers, Venlo; Andreas Theodorus Heijnen, Tegelen, both of Netherlands

[73] Assignee: Oce-van der Grinten N.V., Venlo, Netherlands

[21] Appl. No.: 778,378

[22] Filed: Mar. 17, 1977

[30] Foreign Application Priority Data

Mar. 18, 1976 Netherlands ..... 7602821

[51] Int. Cl.[2] ..... B65H 39/10

[52] U.S. Cl. ..... 271/173

[58] Field of Search ..... 271/173, 176, 64; 270/58

[56] References Cited

U.S. PATENT DOCUMENTS

| | | | |
|---|---|---|---|
| 3,744,790 | 7/1973 | Hoffman | 271/176 X |
| 3,788,640 | 1/1974 | Stemmle | 270/58 X |
| 3,938,802 | 2/1976 | Hartman | 271/173 X |
| 3,997,263 | 12/1976 | Stemmle | 271/64 X |
| 4,026,539 | 5/1977 | Knoops | 271/173 |

*Primary Examiner*—Richard A. Schacher
*Attorney, Agent, or Firm*—Albert C. Johnston

[57] ABSTRACT

A collating apparatus is mounted above a copying machine and includes a housing frame enclosing a conveying mechanism for conveying sheets from the copy-ejection part of the copying machine along a vertical path alongside of which are positioned horizontal trays for receiving the copy sheets as collated. The trays have associated therewith guide elements which are balanced in equilibrium in a first position in which they project into the conveying path to guide sheets into their corresponding trays and which are activated by the receipt of a sheet in the tray to a second position in which they are moved out of the path. The guide elements are locked in this second position by pawl-like locking elements until all locking elements are released by an unlocking means activated by the copy machine start button. The trays, the guide elements and the locking and unlocking elements are supported in a structure which is pivotally connected to the frame enclosing the conveying mechanism at a location which provides the closest proximity to the machine operator so that easy access to the mechanism for maintenance is possible. The entire collating apparatus is so mounted on the copying machine that, when viewed in the horizontal plane, it is fully within the perimeter of the copy machine, does not require any additional floor space and is unaffected by placement near walls or in corners.

8 Claims, 7 Drawing Figures

COLLATING APPARATUS

This invention relates to an apparatus for collating sheets of the type which is associated with a copying machine and which includes a frame forming a housing enclosing a transport or conveying mechanism for conveying sheets along an essentially vertical path or track which, at its input or feed side, communicates with the copy-ejection part of the copying machine. A plurality of essentially horizontal trays or bins for receiving sheets are supported by the frame and positioned along the path of sheet movement as are guide elements which can be brought into the path of movement for directing the sheets for collation.

Collating apparatus of the type which are coupled as loose units to copying or printing machines are generally known. In such systems, the collating apparatus usually occupies a certain amount of floor space in addition to the copying machine. Moreover, the installation is usually such that the collating operation cannot be directly observed from the normal working position of the copying machine operator.

An object of this invention is the provision of an improved collating apparatus which overcomes the above mentioned disadvantages.

This object is achieved, according to this invention, by providing a collating apparatus which is located above the working area of the copying machine and is supported by the copying machine in a position such that, when viewed in the horizontal plane, the collating apparatus lies fully within the perimeter of the copying machine. Thus, the collating apparatus of this invention does not occupy any extra floor space and provides a collating operation that can easily be supervised and controlled by the operator of the copying machine since the apparatus is positioned essentially at operator eye level and in close proximity to the operator.

According to one embodiment of this invention, the trays for receiving the sheets are installed in a supporting structure which is pivotably connected to a vertical shaft of the housing frame in such a manner that, when viewed in the horizontal plane, the pivot shaft is positioned at a location of the frame which is in closest proximity to the normal working position of the operator of the copying machine. An advantage of so positioning the pivot is that supervision and maintenance is facilitated so that when troubles occur in the apparatus, such as jamming of the sheets in the path of sheet movement, the bins can be pivoted away in a direction where no spatial hindrance is encountered. This is particularly advantageous for those copying machines which have been installed against a wall. Moreover, it will seldom be necessary for the copying machine operator to change his place for trouble shooting in the collating apparatus since it is close at hand and easily accessible for maintenance.

This invention also relates to a collating apparatus for collating sheets from a copying or printing machine, of the type including a frame in which at least one series of adjacent trays is positioned, conveyor means for conveying the sheets to be collated one by one along a path extending in proximity to the trays, and guide elements which can be brought into the path of movement of the sheets to be collated, wherein each guide element can be moved between two positions, a first position wherein the guide element extends or projects into the path of movement of the sheets for guiding a sheet into a corresponding tray and a second position wherein the guide element is situated out of the path of movement of the sheets, and each guide element can be moved from the first to the second position by laying a sheet down into the corresponding tray.

With this type of known collating apparatus both the first and second position of the guide element is a stable position of equilibrium. That is, the transition from the first to the second position requires a small quantity of energy, which is supplied by the kinetic energy of the sheets to be collated. The reverse movement also requires only a small quantity of energy, with the result that vibrations, shocks or similar minor forces can cause a guide element to return to the first position at an undesired moment, and consequently disturb the collating operation.

Thus, a further object of this invention is the provision of a collating apparatus of the type described above wherein the disadvantages arising from susceptibility to shock, vibrations and the like are overcome.

This object is achieved, according to this invention, by providing a collating apparatus in which the first position of each guide element is the only stable position of equilibrium and wherein each guide element is provided with a locking pawl element which positively locks the guide element in the second position after it has been brought into that second position. In this manner, the guide elements are prevented from undesired movement from the second to the first position as a result of shocks or other forces arising in the collating apparatus.

Further objects, features and advantages of this invention will be more apparent from the following detailed description of a preferred embodiment of this invention taken in conjunction with the accompanying drawings, in which.

Figure 1:
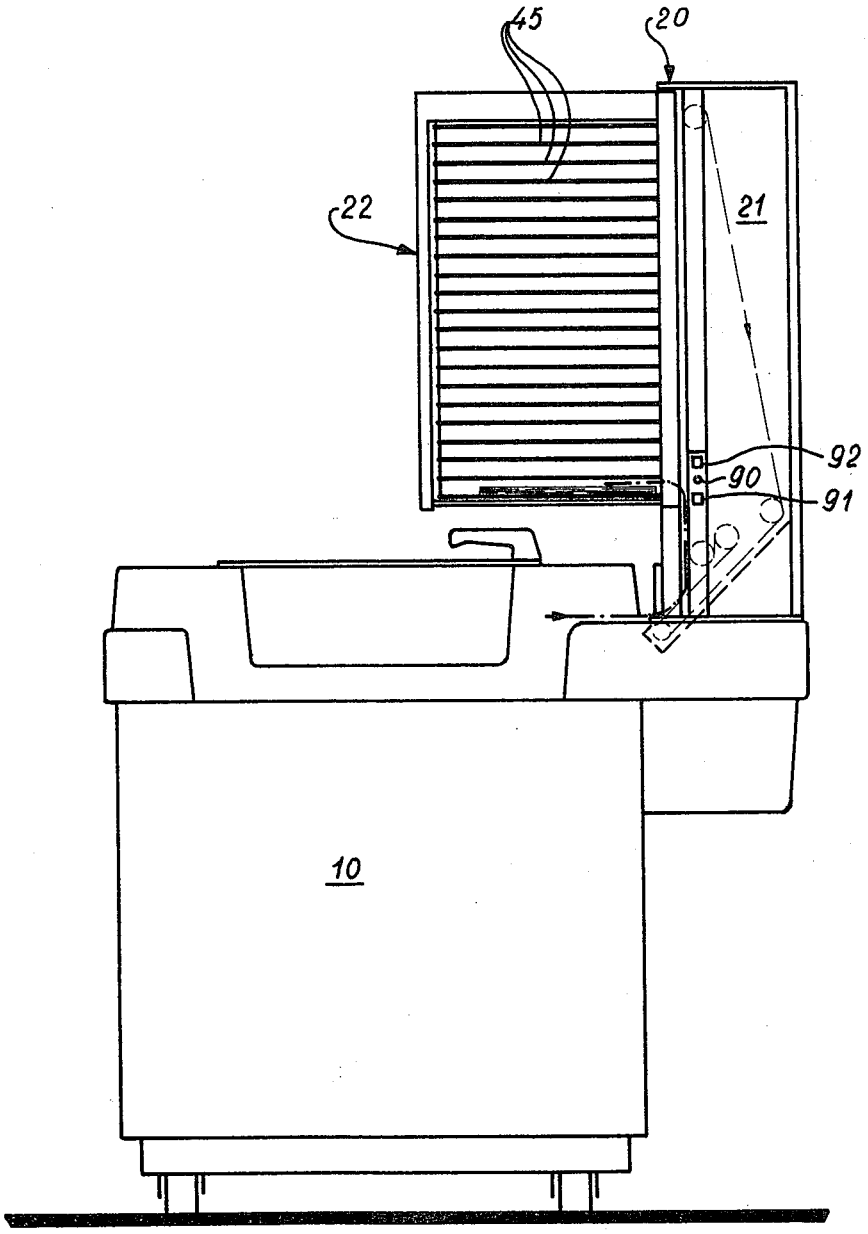
FIG. 1 is a front elevational view of a copying machine provided with a collating apparatus according to an embodiment of this invention.
Figure 2:
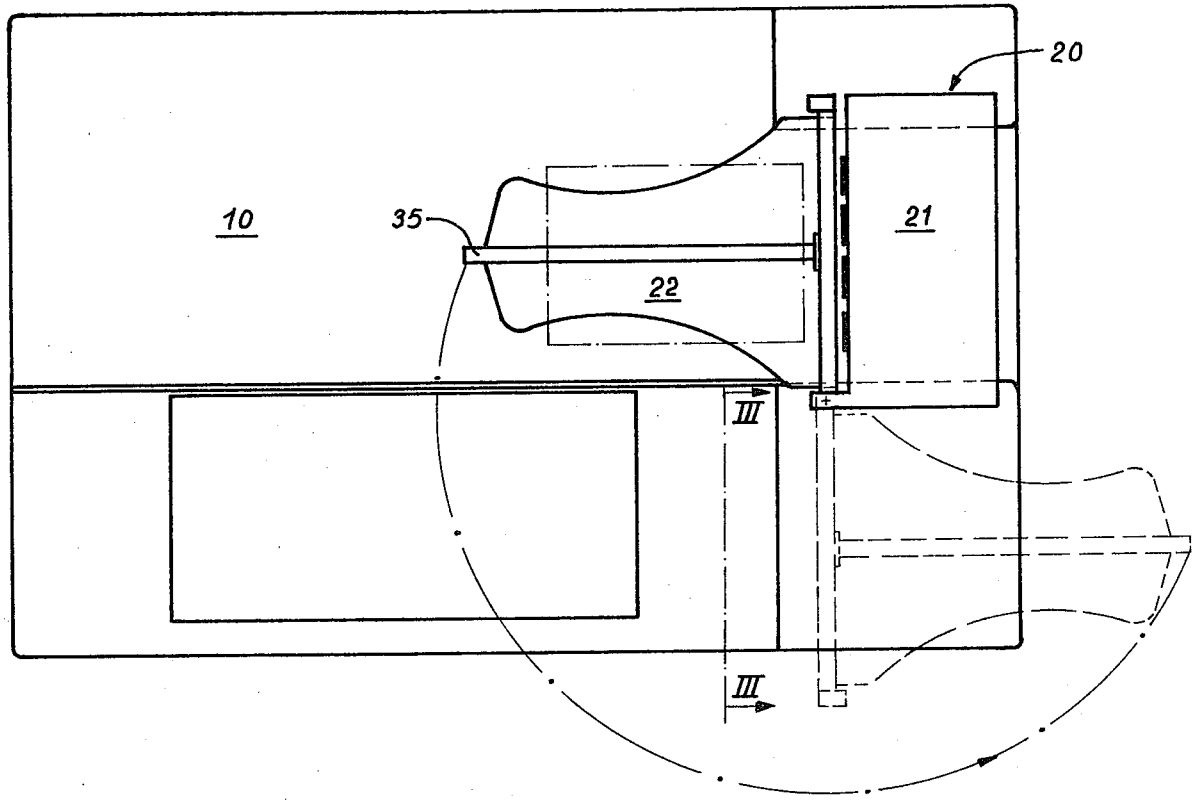
FIG. 2 is a top plan view of the collating apparatus shown in FIG. 1.

Referring to FIGS. 1 and 2, there is shown a copying machine 10 which may be, for example, of the type such as described in Dutch patent application No. 72 05 491. A collating apparatus 20 is located on the copying machine 10, in close proximity to the ejection opening for delivering the sheet copies made. The collating apparatus 20 comprises a conveying section 21 and a collating box 22. The conveying section 21 is of the type described in Dutch patent application No. 74 04 437 comprising a vacuum box in combination with a plurality of conveyor belts. The complete collating apparatus 20 rests on the frame of the copying machine 10 through the front and rear walls of the conveying section 21.

As seen more clearly in FIG. 2, the position of the collating apparatus, in relation to the copying machine, is provided in such a way that the collating box 22 is situated above the working area of the copying machine 10 with the collating apparatus 20 being mounted, through the conveying section 21, on the copying machine 10. As a result, the collating apparatus 20 fully lies within the perimeter of the copying machine 10 when viewed in the horizontal plane, as shown in FIG. 2.

Figure 3:
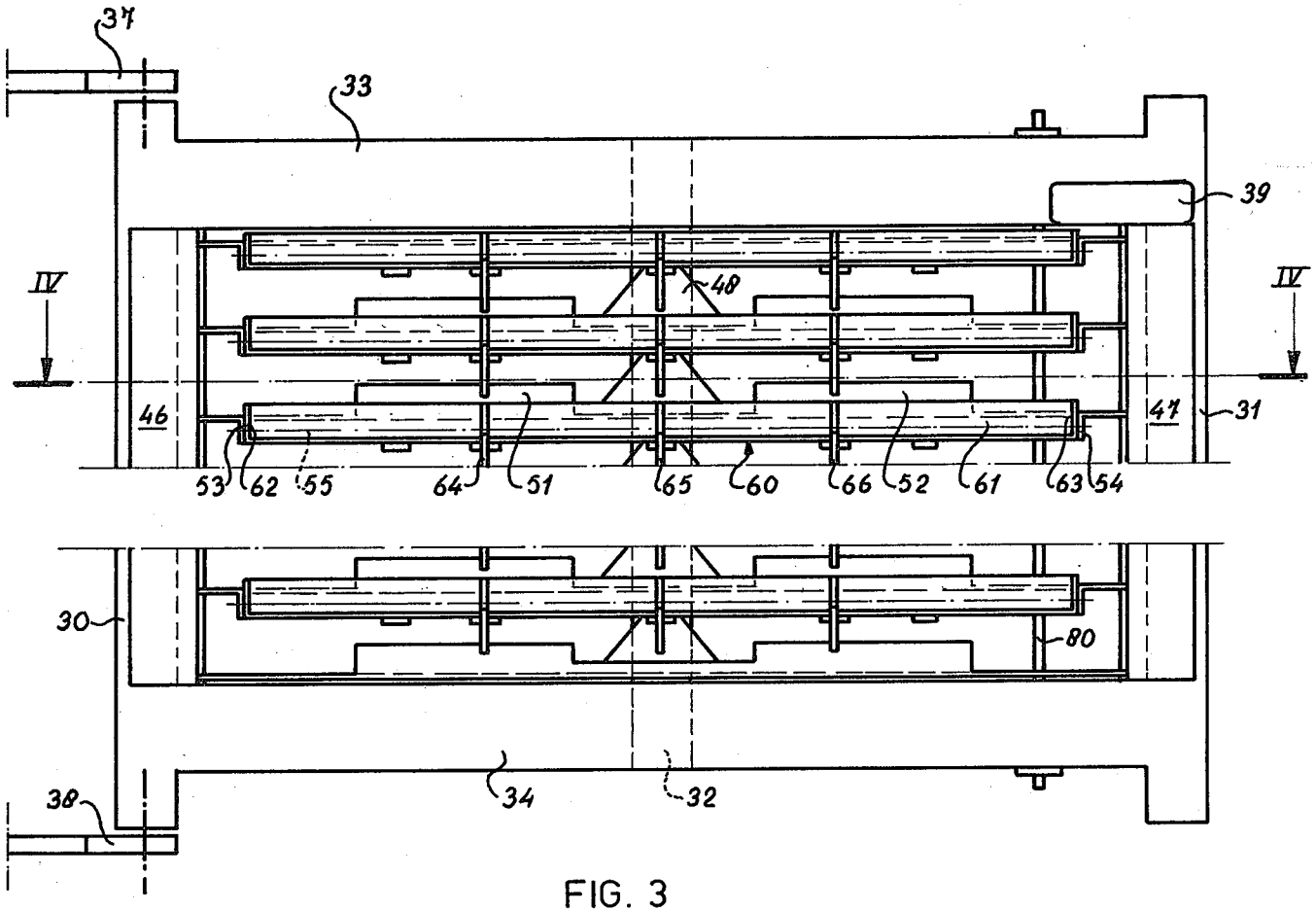
FIG. 3 is a sectional view taken along the line III—III in FIG. 2.
Figure 4:
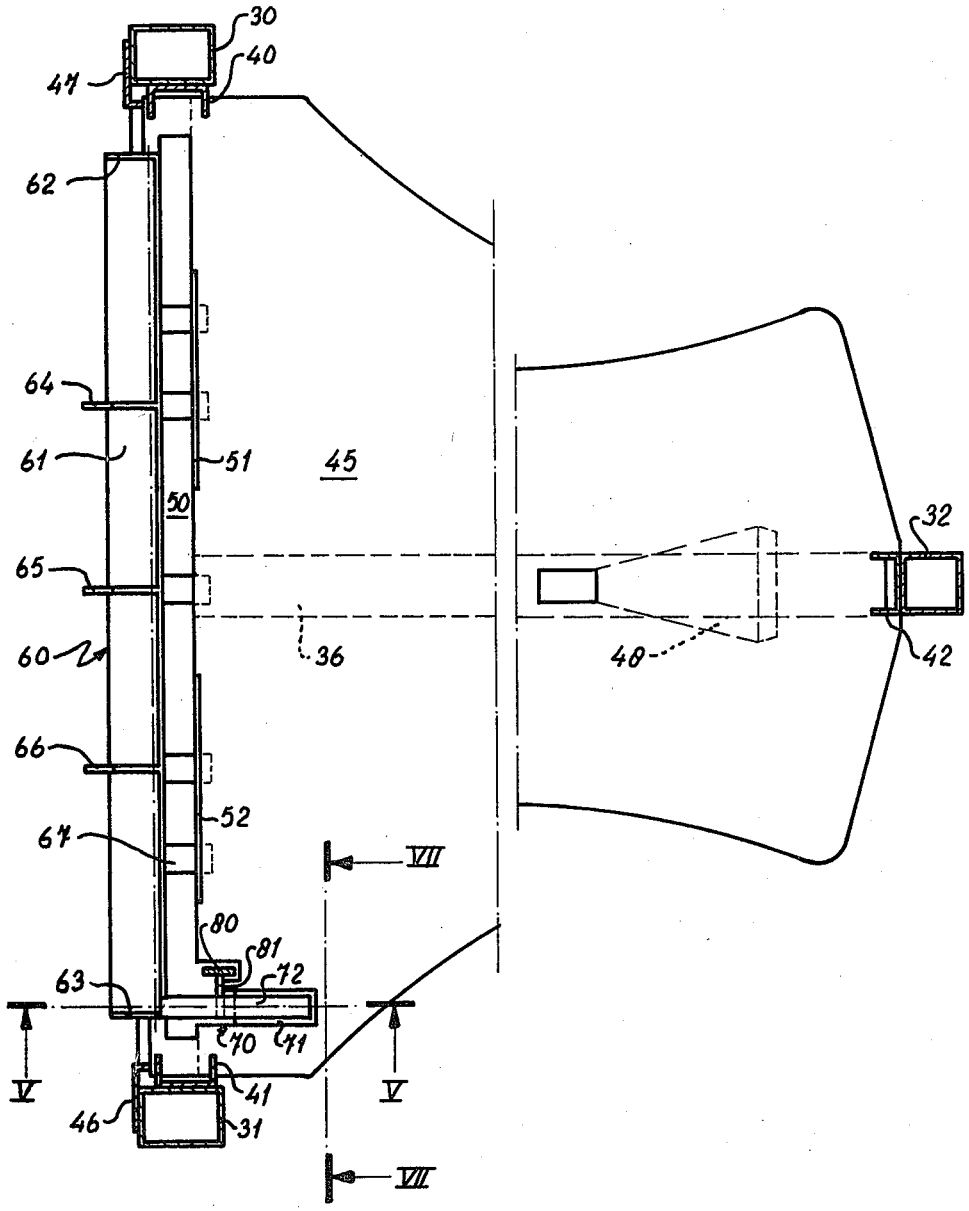
FIG. 4 is a sectional view taken along the line IV—IV in FIG. 3.

The collating box 22 comprises a frame having three rectangular cross-section upright standards 30, 31 and 32, as seen in FIG. 4. The upright standards 30 and 31 are interconnected at their upper and lower ends by horizontal crosspieces 33 and 34, as seen best in FIG. 3. The crosspieces 33 and 34 are connected, approximately at their centers to the standard 32, by horizontal supports 35 and 36, respectively.

The collating box is pivotally joined to the conveying section 21 by means of the upright standard 30, the ends of which are provided with pins which cooperate with the holes in the consoles 37 and 38 of the conveying section 21 to form a hinge as shown in FIG. 3. In this manner of mounting, shown in FIG. 2, the plane formed by the standards 30 and 31 and the crosspieces 33 and 34 is situated near and parallel to the path of conveyance for the sheet copies in the conveying section 21. When the collating box 22 is pivoted to the position shown in FIG. 2 by the interrupted line, the conveying path in the conveying section 21 is freely accessible, so that in case of jamming or similar problems the sheets can be easily removed. Also, this location of the hinge or pivot axis, determined by the holes in the consoles 37 and 38, makes it possible to open the collating apparatus 20 even when the copying machine 10 is installed with a side against a wall, or even when the copying machine 10 is installed in a corner.

The collating box 22 is maintained in the closed or active position for the collating of sheets by means of a permanent magnet 39, which is joined to the crosspiece 33. Means are provided, such as a microswitch, not shown, to stop the conveying section and interrupt the sheet conveying action as soon as the collating box is opened.

From the preceding description it can be seen that the operation of the collating apparatus can easily be checked visually since the collating box is situated in front of and at eye level of the copying machine operator. Moreover, any problems may be easily handled by the operator since it is not necessary for the operator to move from his normal location to service the collating apparatus.

Joined to each of the facing sides of the standards 30 and 31 are the U-shaped upright supports 40 and 41, respectively. A similar U-shaped upright support 42 is joined to that side of the standard 32 which faces the conveying section 21 in the closed position, as seen best in FIG. 4. The flanges of each U-shaped support 40, 41 and 42 are provided with slots at regular distances along their heights. A plate 45 is horizontally positioned in each coplanar set of slots in the flanges of the U-shaped supports, generally as shown in FIG. 2. In this manner, a plurality of plates 45 are positioned above each other to serve as receiving trays of the collating apparatus. The L-shaped members 46 and 47 are joined to the sides of each standard 30 and 31, respectively, which, in the closed position, face the conveying section 21 and thereby retain the trays in place.

A strip 48 is joined to the underside of each plate or tray 45 and, when viewed from the conveying section 21, extends obliquely backwards and downwards to the next tray 45. This strip 48 functions to retard and stack the sheets to be collated into a tray. The edge of each tray 45 which, in the closed position, faces the conveying section 21 is provided with a recess or opening 50, bordered by two flanges, 51 and 52, extending vertically upwards, as best seen in FIG. 4, and two flanges, 53 and 54, extending vertically downwards, as best seen in FIG. 3. The flanges 51 and 52 prevent sheets which have been laid down in a tray 45 from falling out of the tray in the direction of the conveying section 21.

The flanges 53 and 54 have their flat sides facing one another and are each provided with a hole in which a shaft 55 is rotatably mounted. A guide element 60 is fixed to each shaft 55 and rotates with it. Each guide element comprises an L-shaped member 61, which extends parallel to the shaft 55, two end-flanges 62 and 63, which form an integral unit with the L-shaped member 61 and which are fixed on the shaft 55, three scraping blades 64, 65 and 66, positioned at regular distances from each other along the length of the L-shaped member 61 and joined to it and a number of arms 67 which function as counter-weights to give a proper distribution of weight to the entire guide element.

Figure 5:
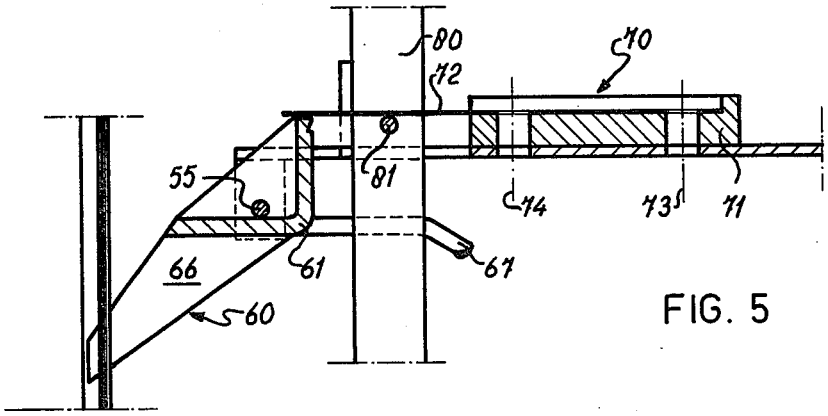
FIG. 5 is a sectional view taken along the line V—V in FIG. 4 and showing a guide element in the first position.
Figure 6:
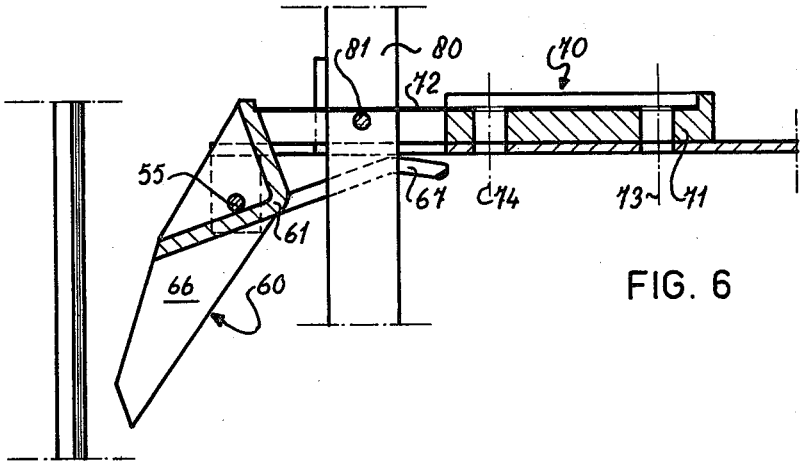
FIG. 6 is a sectional view as in FIG. 5 and showing the guide element in the second position.

Each guide element 60 cooperates with a pawl-like locking element 70 which is joined to each tray 45 in proximity to the standard 31, as seen in FIGS. 4–6. The locking element 70 comprises a holder 71, the upper side of which is provided with a longitudinal recess having an opening at one side for the installation of a blade spring 72. The holder and the blade spring are fastened together and to the upper surface of the tray 45 by means of the screws 73 and 74 in a manner so that the blade spring 72 extends nearly up to the shaft 55.

The elements of this sheet guiding portion of the collating apparatus are assembled in such a way that the first or active position of the guide element 60, in which the guide element extends into the path of conveyance of the sheets to be collated, is the only free position of equilibrium of the guide elements, as a result of the counter-balancing arms 67. The blade spring 72 rests on the upper side of the vertical leg of the L-shaped member 61. As a result of the laying down of a sheet into a tray and the pressure of that sheet against the arms 67, the guide element 60 is caused to move into a second position, shown in FIG. 6, and the blade spring 72 is caused to be positioned behind the vertical leg of the L-shaped member 61. The free edge of the blade spring 72 acts as a pawl cooperating with a groove or detent formed in the leg of the member 61 with the result that the guide element is locked in this position. In this position the sheets conveyed in the conveying path can freely pass the guide element 60.

Figure 7:
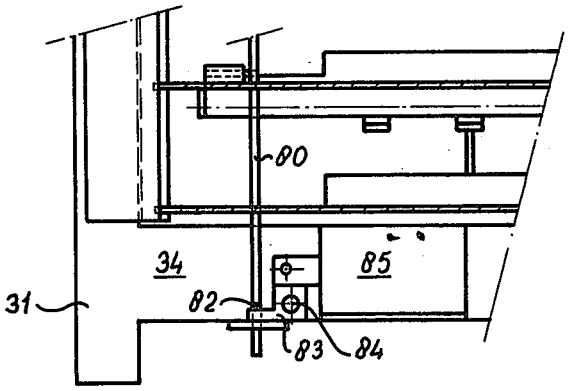
FIG. 7 is a sectional view taken along the line VII—VII in FIG. 4 and showing the guide element locking pawl element.

In order to return a guide element to the active position an unlocking means is installed as shown in FIG. 7. The unlocking means comprises a rod 80 extending over the height of the collating apparatus and along the blade springs 72. A small horizontal pin or shaft-like projection 81 is positioned on the rod 80 at each locking element 70 and extends below the blade spring 72 of the respective locking element 70. When the rod 80 is caused to move upwards, all the blade springs 72 will also be moved upwards and will be freed from the grooves in the leg of the L-shaped members 61, causing all the guide elements 60 to return to their natural positions of equilibrium corresponding with the first or active position. The guide element belonging to the upper tray is always maintained in the active position.

The rod 80 is moved upwards by a pivoting lever 83 which is rotatably mounted on the crosspiece 34 by means of a shaft 84. One end of the pivoting lever 83 is received in the opening 82 at the lower extremity of the rod 80 while the other end of the lever is connected to the anchor of a lifting magnet 85 which is also mounted to the crosspiece 34. The lifting magnet is electrically connected with the start button of the copying machine 10 and coupled with the collating apparatus 20 in such a way that the lifting magnet 85 is activated in synchronization with the operation of the start button and all guide elements 60 are brought to the active position. After the first copy arrives in the collating apparatus 20 it is guided to and laid down in the lowest tray 45 by the guide element 60 corresponding to the lowest tray 45. As a result of the laying down of the copy, the guide element 60 is rotated on the shaft 55 and is locked by the blade spring 72 in the non-active position. Consequently, the second copy will be guided to and laid down in the second lowest tray, and the steps repeated for that tray. When the original being copied is changed, the start button of the copying machine must again be operated and, thus, the guide elements will be activated and the first copy of the second original will also be laid down in the lowest tray and the above steps repeated.

In addition to an on/off switch 91 located on the operating panel 90 of the collating apparatus 20, there is located a second switch 92 for enabling the operator to choose a method for laying all copies down in the lowest tray by permanently exciting the lifting magnet 85 by the switch 92.

While a preferred embodiment of the invention has been described and shown, it is to be understood that the invention is not restricted thereto, but that within the scope of the invention numerous modifications and equivalents can be applied. For example, the construction of the locking element and the unlocking mechanism can be modified so that the blade spring 72 is replaced by a unilaterally rotatable small plate, or the unlocking can be achieved by a descending movement of the rod 80.

We claim:

1. In an apparatus for the collating of sheets of the type coupled with a copying machine and comprising a housing frame, a conveying mechanism located in the frame for conveying sheets along an essentially vertical path which at its feed side communicates with the copy-ejection part of the copying machine, a plurality of essentially horizontal trays positioned along the path of sheet movement and supported by the frame, guide elements associated with the trays, the guide elements being capable of being brought into the path of movement of the copies to be collated to guide the copies to the trays, the improvement comprising means locating the collating apparatus above the working surface of the copying machine and supporting the collating apparatus on the copying machine in manner such that, when viewed in the horizontal plane, the collating apparatus lies fully within the perimeter of the copying machine, a supporting structure supporting the trays, the supporting structure being pivotably joined to the housing frame through a vertical shaft connected to the frame at a location on the frame which is in close proximity to the normal working position of an operator of the copying machine, so that the collating apparatus is positioned essentially at operator eye level and is reachable by the operator for trouble shooting without need for the operator to change from the normal operator working position.

2. A collating apparatus for the collection of sheets, comprising a frame, at least one series of adjacent trays positioned essentially horizontally in the frame, conveying means for conveying the sheets to be collated one by one along a path extending near the trays, guide elements associated with the trays which can be brought into the path of movement of the sheets to be collated, each guide element being movable between two positions, a first position wherein the guide element extends into the path of movement of the sheets for guiding sheets, and a second position wherein the guide element is situated out of the path of movement of the sheets, each guide element being activatable from the first to the second position by laying a sheet down into the corresponding tray with which the guide element is associated, the first position of each guide element being the only stable position of equilibrium, each guide element being provided with a flexible strip locking pawl with one end clamped relative to the frame, the second end resting freely on a horizontal part of the guide element in the first position of the guide element and cooperating in a detent clamping way with an essentially vertical part of the guide element in the second position of the guide element to positively lock the guide element in that position, and a common guide element activating means which upon activation brings all guide elements into the first position and releases the locking of the guide elements which are in the second position, the common actuating means comprising a vertical rod which is movable up and down in a parallel direction with respect to the frame, the rod being provided with a horizontal pin for each guide element flexible strip locking pawl which lifts the second end of such locking pawl during an upward movement of the rod and releases the same from the vertical part of the guide element.

3. A collating apparatus for the collation of sheets, comprising a frame, at least one series of adjacent trays located in the frame, conveying means for conveying the sheets to be collated one by one along a path extending near the trays, guide elements associated with the trays which can be brought into the path of movement of the sheets to be collated, each guide element being movable between two positions, a first position wherein the guide element extends into the path of movement of the sheets for guiding sheets, and a second position wherein the guide element is situated out of the path of movement of the sheets, each guide element being activatable from the first to the second position by laying a sheet down into the corresponding tray with which the guide element is associated, the first position of each guide element being the only stable position of equilibrium, and each guide element being provided with a locking element which, when the guide element has been brought to the second position, positively locks the guide element in that position.

4. A collating apparatus as claimed in claim 3, further comprising a common guide element activating means which upon activation brings all guide elements into the first position.

5. A collating apparatus as claimed in claim 4 wherein the activation of the common activating means releases the locking of the guide elements which are in the second position.

6. A collating apparatus as claimed in claim 5 wherein the trays are positioned essentially horizontally, the locking element comprises a pawl, a first end of which is movably connected with respect to the frame, and the second end of which rests freely on a horizontal part of the guide element in the first position of the guide element and cooperates in a detent clamping way with an essentially vertical part of the guide element in the second position of the guide element.

7. A collating apparatus as claimed in claim 6 wherein the locking element pawl comprises a flexible strip with one end clamped relative to the frame, the second end resting on a horizontal part of the guide element in the first position of the guide element and cooperating in a detent clamping way with an essentially vertical part of the guide element in the second position of the guide element.

8. A collating apparatus as claimed in claim 6 wherein the common actuating means comprises a vertical rod which is movable up and down in a parallel direction with respect to the frame, the rod being provided with a horizontal pin for each guide element locking element which lifts the second end of such locking element during an upward movement of the rod and releases same from the vertical part of the guide element.

* * * * *